United States Patent [19]

Kaplan

[11] 4,441,340

[45] Apr. 10, 1984

[54] ENERGY SAVING LAUNDRY SYSTEM

[76] Inventor: Darryl Kaplan, P.O. Box 1, Woodridge, N.Y. 12789

[21] Appl. No.: 349,996

[22] Filed: Feb. 18, 1982

[51] Int. Cl.[3] ..... D06F 31/00; D06F 39/08

[52] U.S. Cl. ..... 68/12 R; 68/18 F; 68/27; 68/207; 68/208; 137/266; 137/340

[58] Field of Search ..... 68/12 R, 18 R, 18 F, 68/27, 207, 208; 134/95, 97, 98, 99, 186; 137/255, 266, 340

[56] References Cited

U.S. PATENT DOCUMENTS

| | | | |
|---|---|---|---|
| 1,537,842 | 5/1925 | McCarty et al. . | |
| 1,580,640 | 4/1926 | Bibby . | |
| 1,940,241 | 12/1933 | Dovee . | |
| 1,980,860 | 11/1934 | Hetzer . | |
| 2,302,012 | 11/1942 | Dyer . | |
| 2,514,050 | 7/1950 | Grebe . | |
| 2,554,566 | 5/1951 | Geldhof et al. . | |
| 2,588,774 | 3/1952 | Smith . | |
| 2,591,179 | 4/1952 | McBean . | |
| 2,700,287 | 1/1955 | Sulzmann . | |
| 2,733,587 | 2/1956 | McKendree . | |
| 2,786,483 | 3/1957 | Warhes . | |
| 2,793,652 | 5/1957 | Evans . | |
| 2,811,983 | 11/1957 | Valentine . | |
| 2,877,788 | 3/1959 | Clark . | |
| 2,932,184 | 4/1960 | Perlt . | |
| 2,972,877 | 2/1961 | Platt . | |
| 3,027,908 | 4/1962 | Cochran . | |
| 3,029,838 | 4/1962 | Houser . | |
| 3,103,225 | 9/1963 | Schmittmatzen . | |
| 3,253,431 | 5/1966 | Minhinnett . | |
| 3,353,378 | 11/1967 | Kahn . | |
| 3,695,291 | 10/1972 | Sims . | |
| 3,841,116 | 10/1974 | Klein et al. | 68/27 X |
| 3,897,821 | 8/1975 | Babonovic et al. . | |
| 4,195,498 | 1/1980 | Pellerin . | |

FOREIGN PATENT DOCUMENTS

| | | | |
|---|---|---|---|
| 426019 | 3/1935 | United Kingdom . | |
| 990098 | 4/1965 | United Kingdom | 68/27 |

*Primary Examiner*—Philip R. Coe

*Attorney, Agent, or Firm*—Browdy & Neimark

[57] ABSTRACT

Energy saving systems for a commercial laundry utilizing a plurality of machines wherein a simple diverter valve directs the effluent from the machines to either a waste area or a recycle tank. In one embodiment a system of troughs in the floor of the laundry are provided to collect the effluents from the different machines are directed to one or the other by the diverter valve. In the second embodiment, a self-contained modular device is provided, but again with separate diverter valves to control the effluent of each machine. Numerous optional features and many combinations of the features are possible.

19 Claims, 8 Drawing Figures

ENERGY SAVING LAUNDRY SYSTEM

Figure 1:
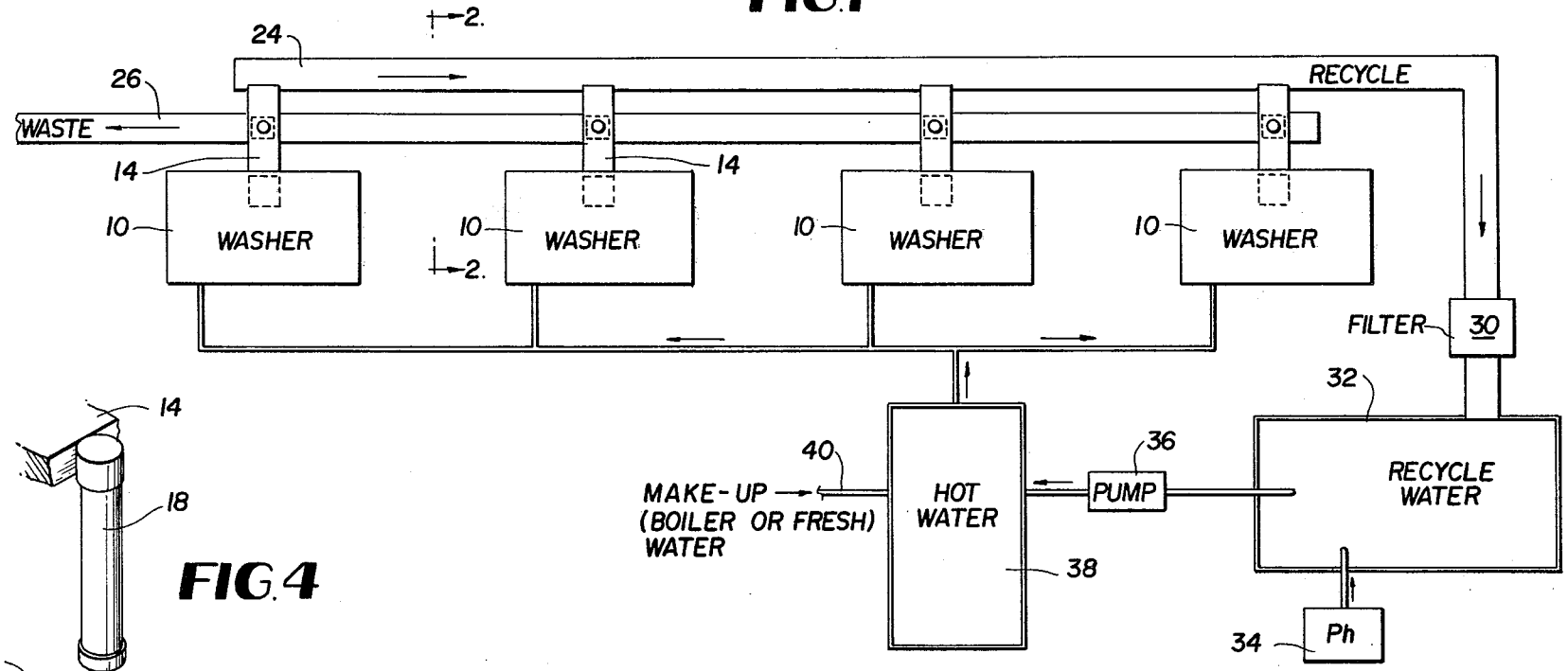

This invention pertains to the washing of laundry such as towels, sheets etc., and more in particular the invention pertains to large scale commercial laundry installations wherein a plurality of washing machines and large quantities of water and energy are used. Such installations are commonly found in hospitals, hotels, prisons, and the like.

In commercial laundries of the character described, a plurality of separate washing machines, each with its individual controls, operates on a separate load of laundry by subjecting the laundry to a predetermined sequence of laundering steps, including washing, rinsing and the like. Typically, the laundry is first washed in hot water containing soaps and other additives, and is thereafter rinsed using hot or warm, or sometimes cold, water. Thus, each machine subjects each load of laundry to a sequence or plurality of individual washing steps. Each time one of the different baths, wash water, rinse water, and the like, is changed, the old bath water is ejected from the washing machine. In many systems, fresh water is used for each bath and the water of the previous step wasted by being sent to a sewer.

The present invention is directed towards saving or recycling the considerable waste involved in simply discarding each bath water. This waste involves, primarily, waste of the heat energy contained in the water, waste of the water itself, and the cost involved in treating the sewerage. Each of these areas of waste, that is heat energy, fresh water and sewerage treatment, are all extremely expensive, and thus the invention achieves considerable economies for the commercial laundry in which the invention is used. The invention accomplishes these desiderata basically, by utilizing the fact that rinse water, in some cases and in some stages especially where a plurality of rinsing steps are used, is still quite clean, and with the addition of certain treatment steps, that rinse water can be recycled as wash water for the next machine load cycle.

The invention is not to be confused with the so-called "suds savers" devices which are commonly employed on individual washing machines. The concept is similar, however such prior art devices simply save the wash water and then reuse it as wash water for the next cycle. The difference is that the quality of the washing for the second and subsequent cycles is severly impeded by the soil and other undesireable material in the wash water. Further, any such one by one machine system also suffers the disadvantage that the hot water has a long time to "wait" until it is reused, thus allowing the heat energy in that water to dissipate.

Other prior art systems do recycle wash water as rinse water, but, here again, that is done on a one machine at a time basis, and the disadvantages inherent in single machine installations is present here as well. These disadvantages include the addition of substantial and complicated mechanisms and controls inside the washing machine, the need to store water individually for each washing machine, and, in general, the lack of an overall or system approach to the problem of saving water energy and sewerage in such large installations.

The present invention provides a significant step forward in the art of commercial laundry systems by providing an overall systems approach. The recycleable water from each machine is directed to a common holding area. In this common holding area, the recycleable water is treated, again on a large scale and in common, and is then recycled back into the system at the hot water area where it is used for whatever purposes the particular installation requires hot water.

Thus, as so far described, it can be seen that the invention provides substantial versatility over the prior art. The recycleable water can be tapped out of the machines in the system at whatever point in the particular system it is logical and proper to do so. That is, when washing small loads or lightly soiled loads or some combination thereof, perhaps all of the water used could be recycled. In other situations where heavy loads or heavily soiled loads or combinations are used, perhaps less water could be recycled. By very simple modifications to the controls, which are centrally located and which are external of the machines, it is possible to modify the invention energy saving system to the particular laundry installation and to the particular types and quantities of laundry being operated upon.

The invention requires virtually no modification of commercial laundry machines at all. Such machines are extremely large and extremely expensive. They typically have programmed washer controllers to perform different sorts of cycles. The invention provides, in both embodiments disclosed herein, a simple "L" diverter valve positioned at the water exit from each machine. The addition of this diverter valve at the water exit of the machine, together with quite simple modifications of the controls of the machine in its timer, constitutes all of the modification which the invention imposes upon commercial laundry machines with which it is used.

The two embodiments of the invention can be thought of as the retrofit version and the central installation. These two nomenclatures are basically for the sake of convenience, either could be retrofitted and either could be provided in a new commercial laundry installation. Thus, the titles are not to be considered in a limiting nature.

The retrofit version utilizes, as is very common in many laundrys, a system of inground troughs wherein the waste water and recycled water are separately controlled and permitted to flow as needed throughout the laundry installation. Such troughs are typically cast right into the concrete floor of the commercial laundry. In such case, the invention "L" shaped diverter valve is positioned at the water exit of the machine over the pair of troughs, one for recycle and one for waste. When installing the invention system in such a laundry, it may often be necessary to cut the second trough, the recycle water trough, together with a recycle water holding pit or tank into which that trough feeds. The "L" shape valve, under the control of the central control or the particular washing machine's control, permits the effluent water to either go to recycle or to sewer as is required by the particular constraints of the system at that particular time.

In its second embodiment, the invention provides a system of tanks built into a separate free standing tank unit, or built into a system of pits sunk into the floor of the commercial laundry, or any combination thereof. In this case, each machine delivers its effluent directly to the central point, and that effluent is controlled by a separate valve for each machine to direct the machine's waste water into either waste or recycle as needed.

The invention also teaches numerous other features which are particularly useful in the second free standing embodiment, but which may also possibly be adaptable into the first retrofit embodiment, as such opportunity may present itself dependent upon the particular configuration and restraints in a particular commercial laundry in which the invention is to be installed. These features include a heat exchanger or coil or the like located in the waste water tank or pit or trough to preheat fresh feed water or makeup water feeding into the system. The heat exchanger could also reheat recycle water before it feeds into the hot water system feeding into the machines. Alternatively, the recycle heat exchanger can be omitted where the temperatures of the water are such that no energy need be saved. Another feature of the invention in the second embodiment is the arrangement of having these tanks nested, with the tank for the hottest water being located at the innermost part of the arrangement so that the heat energy is naturally saved by natural flows through the walls of the tanks in the system.

Yet another invention feature pertains to filter means provided between the recycle and hot water tanks or pits which, in an overflow manner provides very efficient filtering means, which are at the same time readily accessible from the top of the system. Since it is anticipated that the entire central installation would be set down into the ground, this means that the filter can be serviced from floor level. In addition, the provision of the overflow type system automatically helps in settling, that is, the cleanest water, the water most free of solids, will be at the top, and will over flow into the hot water tank for feeding back to the machines.

An important advantage of the invention resides in its tremendous versatility. An invention system can be used with or without an additional conventional water boiler or heater, dependant upon the particular constraints of the system being serviced. Where the boiler is used, it is most conveniently positioned directly adjacent or above the hot water tank. In this manner, fresh makeup and or water from the hot water pit can be fed into the boiler as feed water, and a header or manifold can be provided at the hot water exit from the boiler to feed all of the machines in the system being serviced. By a very simple controls and pump arrangement, some of which can be automatic, various combinations of fresh water, recycled water, combinations thereof, some bypassing of the boiler, optional use or not use of the heat recapture coil in the waste water tank, and the like, are all possible. Further, all of these options and facets of the versatility are possible with no changes in the equipment, but only with small adjustments in the controls. The invention also provides for conventional treatment of the water in the hot water tank, which water, as can now be appreciated, is a combination of fresh makeup water and recycle water from the machines. This treatment comprises neutralization, adjustment of pH., and other treatments well known to those skilled in the water treatment and laundry arts.

Figure 2:
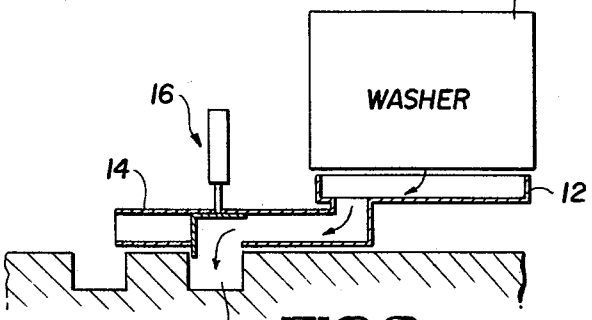
Figure 3:
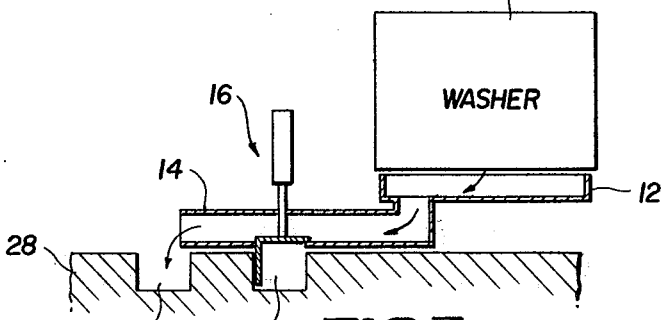
Figure 4:
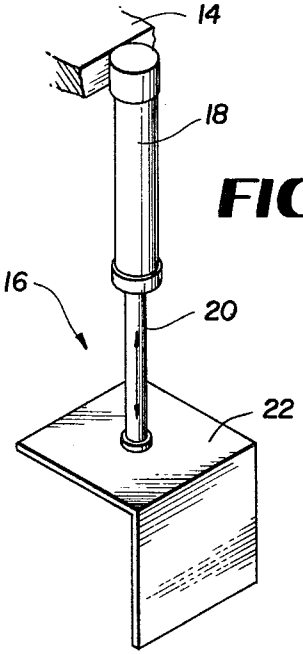
Figure 5:
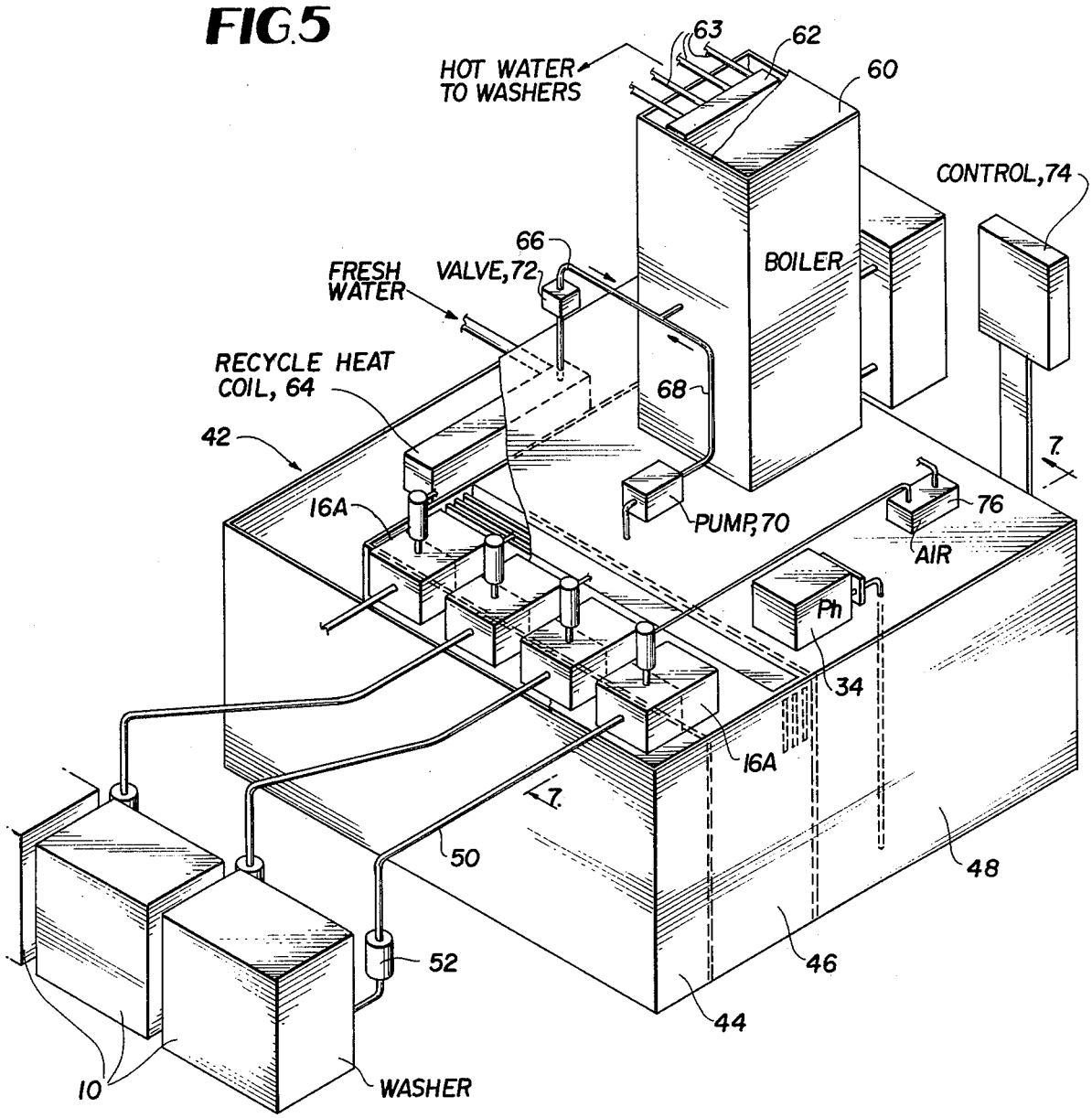
Figure 6:
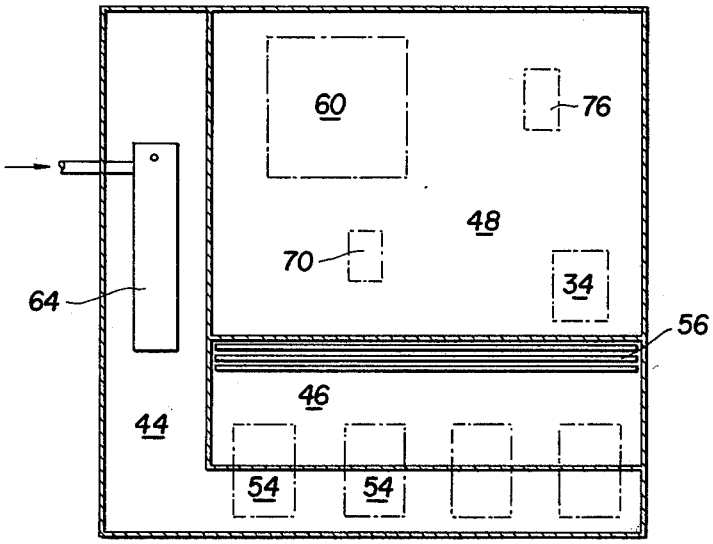
Figure 8:
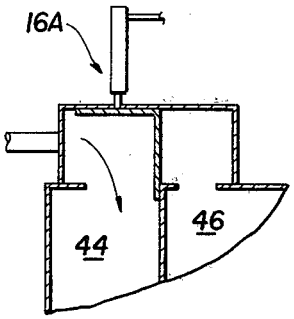
Figure 7:
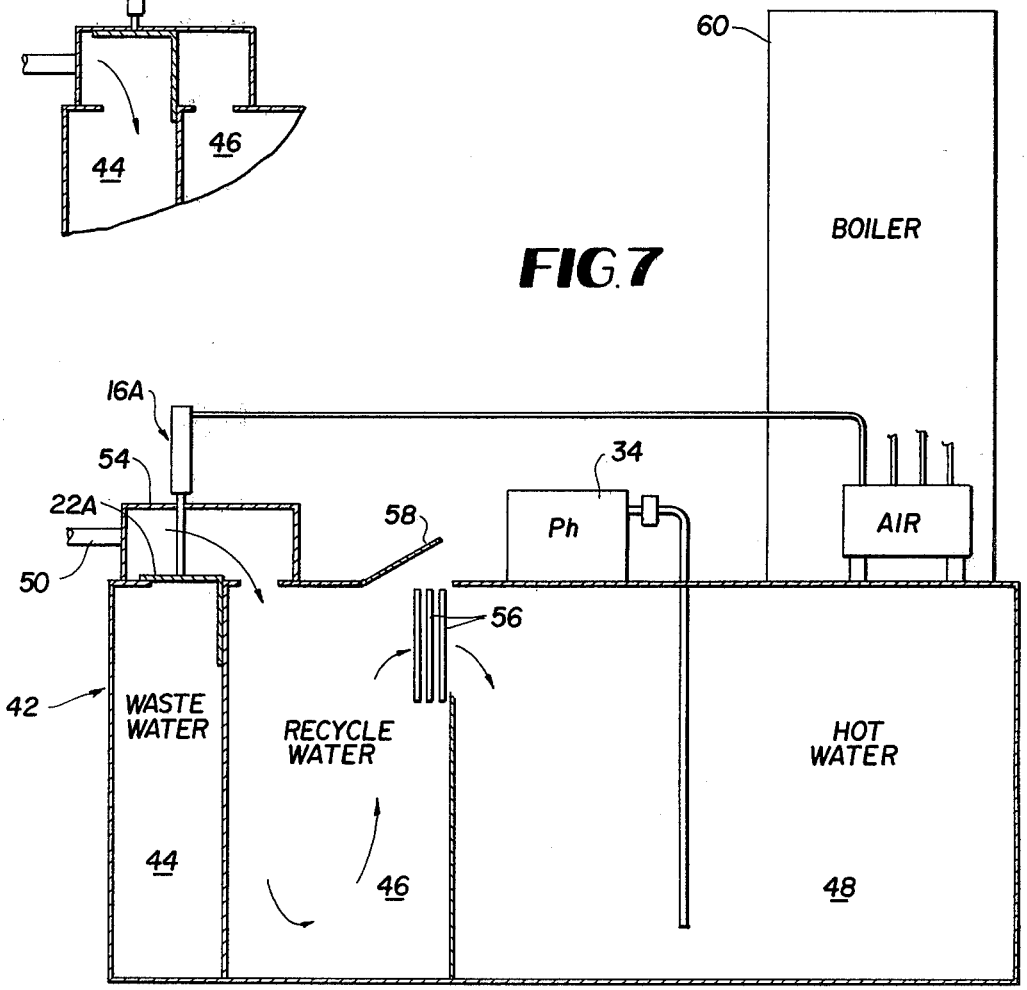

The above and other advantages of the invention will be pointed out or will become evident in the following detailed description and claims, and in the accompanying drawing also forming a part of the disclosure, in which:

FIG. 1: is a showing of a first embodiment of the invention, partially in plan view and partially schematic;

FIG. 2: is a vertical cross-sectional view taken on line 2—2 of FIG. 1;

FIG. 3: is a view like FIG. 2 showing the "L" shaped diverter valve in its other position;

FIG. 4: is a perspective elevational view of the invention diverter valve removed from its housing;

FIG. 5: is a perspective elevational view of a second embodiment of the invention;

FIG. 6: is a top plan view thereof;

FIG. 7: is a vertical elevational cross-sectional view taken on line 7—7 of FIG. 5; and FIG. 8: is a view similar to the upper left hand corner of FIG. 7 showing the diverter valve in its second position.

Referring now in detail to the drawings, in FIG. 1 there is shown a first embodiment of the invention which, for the sake of convenience only and not as a limitation as explained above, is called the retrofit version. A plurality of washing machines 10, four being shown in the drawing by way of example only, are provided in the commercial laundry to which the invention is being applied. Each machine 10, shown in FIGS. 2 and 3, is modified by the addition of a pan 12 at its underside from which the machine effluent exits, as indicated by the arrows. If the machine discharges water to the side, the pan 12 would be modified accordingly. Pan 12 feeds into a conduit 14 in which is mounted the invention diverter valve 16. The valve is shown in greater detail in FIG. 4, and this same diverter valve is used in both embodiments of the invention.

Referring to FIG. 4, the diverter valve comprises an air cylinder 18 which drives a rod 20 at the end of which is a diverter valve 22. The valve member 22 comprises, very simply, an "L" shaped member which has a width, on both its horizontal and vertical sections, which closely fits into the conduit 14. The top or horizontal part of the valve member 22 appears in dotted lines in FIG. 1 from which its close fit within the conduit 14 can also be seen.

Referring now to FIGS. 2 and 3, the floor 28 of the commercial laundry in which the washers 10 and the invention system is housed is formed with a pair of troughs 24 and 26 which run closely adjacent to each other and to all of the washers 10. Of course, as will be clear to those skilled in these arts, the invention is not limited to use with troughs, but pipes and conduits of all sorts can also be used and can be used in other positions than below the machines with the addition of suitable pumps.

In operation, the raised position of the "L" shaped diverter valve 16 directs the effluent from the washer via pan 12 and conduit 14 into the waste water trough 26, as shown in FIG. 2. FIG. 3 shows the lowered position of the "L" shaped diverter valve 16, in which the effluent water from the washer goes from conduit 14 into the recycle water trough 24, valve 16 having closed off trough 26.

Thus it can be appreciated that the addition, by retrofit, of the invention system to an existing laundry is an extremely simple matter. The addition of the pans 12 with the conduits 14 carrying the diverter valves 16 is all that is done physically to the machines. In addition, the programmers for the machines are tapped into to operate relays and other controls to control the valve 16 between the FIGS. 2 and 3 positions as needed. Further, once the tap is made into the machine control, the central controls can provide overrides or additional programming to control the valve 16 independantly or in conjunction the programmers in the machines. This is, of course, easily within the expertise of those skilled in the machine control arts.

Referring again to FIG. 1, trough 24 contains a filter means 30 through which the recycle water and the trough passes before entering a recycle water tank or pit 32.

It will of course be understood that the words "tank" and "pit" are used interchangeably in this specification and claims in that the invention is applicable to either an above ground, a below ground, or any combination of such installations.

Means are provided to adjust the chemistry and otherwise treat the recycle water in the pit 32, and this is indicated by the box 34, marked "pH". A pump directs the treated recycle water into a hot water storage tank 38, which is also fed makeup water as indicated by the arrow 40. As described above, this makeup water can be either from a boiler, or just fresh water, or water which has been preheated by salvaging the heat in the waste water in the trough 26, as will be described in greater detail with respect to the second embodiment below.

Referring now to FIGS. 5 through 8, a second embodiment 42 of the invention is shown. This can be thought of as the self-contained or new installation central unit, however, again, as set forth in greater detail above, numerous of the features are interchangeable, and the nomenclature of "new" and "retrofit" are only for convenience.

The second embodiment 42 comprises an array of nested tanks or pits, see also FIG. 7, comprising a waste water tank 44, a recycle water tank 46, and a hot water tank 48. In this embodiment shown, each washer 10 is connected by a conduit 50 containing a pump 52 to a separate "L" shaped diverter valve 16A, one for each of however many machines 10 are being serviced. Each "L" shaped diverter valve 16A is housed in a valve housing 54, which corresponds in concept and function to the conduit 14 of the first embodiment of FIGS. 1, 2, and 3.

The housing 54 overlies parts of the waste water tank 44 and the recycle water tank 46. As is readily apparant from a comparison of FIGS. 7 and 8, in one position of the valve 16A, the effluent from each machine 10 delivered via pump 52 and conduit 50 is directed into one or the other of the waste water and recycle water tanks 44 and 46. Filter means 56 are provided in the wall between the recycle and hot water tanks 46 and 48. This filter means is positioned at the upper end of the tank, so that sediment and the like will automatically settle to the bottom, and the cleanest water only will recycle across from tank 46 into tank 48. A trap door 58 is provided in the top wall of the composite unit of embodiment 42, whereby the filter means 56 are readily reached for service. As can be seen in FIG. 5, the filter means extends across the full length of the tanks 46 and 48.

Embodiment 42 also includes a boiler 60, which, as described below, is an optional feature of the invention. That is, depending upon the particular laundry in which the invention is being used, the water temperatures available, and the like, a boiler for makeup water may or may not be needed. Boiler 60 may include a header 62 from which the hot water is fed through a plurality of conduits 64 to the various washers 10.

Another optional feature shown in FIG. 5 is a heat exchanger or recycler 63 located in the waste water tank 44. Any conventional coil, fin, tube, or any other heat exchanger could be used in the invention as the element 64. The output of the heat exchanger 64 is delivered through one leg 66 of a plumbing arrangement which feeds boiler 60 which internally feeds header 62 which in turn feeds the washers 10. A second leg 68 of the plumbing arrangement includes a pump 70 which delivers hot water in the inner tank 48 to header 62 via the boiler. A valve 72 is positioned in the first leg 66 of this feed plumbing arrangement. The valve 72 may be automatically thermostatically or otherwise controlled, such as for example by the main control panel 74 which operates the entire system.

The arrangement described in the paragraph immediately above is instrumental in providing the versatility of the invention. That is, for example, with valve 72 closed, and with there being sufficient heat in the hot water in the tank 48, the boiler can be bypassed, the pump 70 directing water from the tank 48 directly to header 62 for feeding back to the washers 10. If makeup water is required, the valve 72 will open automatically or under the control of the logic in the control box 74, and fresh water will be added to the feed or can be provided entirely in place of the feed provided from the tank 48 via pump 70. Variations and combinations are easily possible by operating the valve 72 and the pump 70 appropriately.

An air compressor 76 is provided in the installation 42 to feed the valves 16A, individually, to control them. All of the wiring and other control means from the box 74 to the various elements have been omitted from the drawing in that they are not needed for a complete understanding of the invention, and, in any case, such control wiring and the like is well within the expertise of those skilled in these arts.

An important advantage of the invention in both embodiments and in other embodiments made up of combinations of the various features, is that the effluents from all cycles and all baths of each machine operation are handled collectively in a single tank, and are controlled by the very simple apparatus comprising, basically, only the "L" shaped diverter valves 16 and 16A. The heat in the non-recyclable water can be salvaged, optionally, the system can work with or without a supplemental boiler, and the invention is amenable to use as either a wholly new installation, or to be retrofitted, requiring very little and simple modifications, to existing laundry installations. All such commercial laundrys already have a hot water supply system and the present invention recycles the salvaged hot water directly back into that existing hot water supply system. In its second embodiment a self-contained modular device can be provided. Wherein the tanks are nested to provide an advantageous heat flow from the coolest water at the outside to the hottest water at the inside.

While the invention has been described in detail above, it is to be understood that this detailed description is by way of example only, and the protection granted is to be limited only within the spirit of the invention and the scope of the following claims.

I claim:

1. In a laundry installation comprising a plurality of individual washing machines each comprising a single water exit means for water effluent from all baths and control means for controlling the automatic operation of each said machine through the several steps and baths in each washing cycle of each said machine, the improvement comprising a water and energy conserving system comprising waste water handling means and recycle water handling means, diverter valve means associated with the exit means of each machine for individually directing the effluent of each bath in each machine step to either said waste water handling means or said re-cycle water handling means, each said diverter valve means being controlled at least in part by said machine's control means, hot water storage means, means to supply water from said recycle water handling means to said hot water storage means, means to supply hot water from said hot water storage means to each of said washing machines, said diverter valve means comprising a power operated diverted valve member positioned in said water exit means, said water exit means being positioned above both said waste water handling means and said recycle water handling means, and said diverter valve means comprising an "L" shaped valve member which, in one position of said diverter valve means directs the water effluent from said machine into one of said waste water handling means and said recycle water handling means and in the other position of said diverter valve means directs the water effluent from said machine into the other of said waste water handling means and said recycle water handling means.

2. The combination of claim 1, said waste water handling means and said recycle water handling means comprising a pair of troughs, said single water exit means for each said machine comprising a pan means to collect the effluent from the machine, and conduit means communicating with both of said waste water trough and said recycle water trough and adapted to direct the effluent from said machine and said pan means through said conduit means to one or the other of said waste water trough and said recycle water trough.

3. The combination of claim 1, wherein said water exit means comprises a conduit extending from each said washing machine to said diverter valve means, said waste water handling means and said recycle water handling means comprising a pair of tanks positioned closely adjacent one another, said diverter valve means comprising a valve housing overlying both of said waste water tank and said recycle water tank, and said diverter valve means further comprising a diverter valve member having a raised position and a lowered position and adapted to directed the effluent water from said machine to one or the other of said waste water tank and said recycle water tank in each of its two positions.

4. The combination of claim 3, wherein said exit means from said machine comprises a conduit, and a pump means in said conduit to pump the water from said machine to said diverter valve means associated with said tanks.

5. The combination of claim 1, means to supply fresh makeup water to said hot water storage means, heat exchanger means positioned in said waste water handling means, and means to direct said fresh makeup water through said heat exchanger means, whereby said fresh water is preheated by transferring the heat from the waste water into said fresh water before said fresh water is fed into said hot water storage means.

6. The combination of claim 1, a water boiler associated with said hot water storage means, fresh makeup water supply means, means to supply water from one, the other, or combinations of both of said fresh water supply means and said recycle water handling means to said boiler, said boiler comprising manifold means to supply water to all of said washing machines individually, and means to selectively bypass the water-heating means in said boiler in flowing water from one, the other, or combinations of both of said fresh water supply and said recycle water supply through said boiler to said manifold means.

7. The combination of claim 6, means to supply fresh makeup water to said hot water storage means, heat exchanger means positioned in said waste water handling means, and means to direct said fresh makeup water through said heat exchanger means, whereby said fresh water is preheated by transferring the heat in the waste water in said fresh water before said fresh water is fed into said hot water storage means, and automatic valve means controlling the flow of preheated feed water from said heat exchanger into said boiler.

8. The combination of claim 1, said hot water storage means, said recycle water handling means, and said waste water handling means comprising an array of nested tanks, with the recycle water tank being located between the outermost waste water tank and the innermost hot water tank, whereby the natural flow of heat between said tanks tends to be economical of the heat energy in the water in all of said tanks.

9. The combination of claim 1, wherein said water and energy conserving system is substantially entirely self-contained in a modular unit, said unit comprising an array of tanks or pits one of which comprises said hot water storage means, another one of which comprises said waste water handling means, and a third one of which comprises said recycle water handling means, all of said pits or tanks being in closely spaced juxtaposition to each other, said means to supply water from said recycle water handling means to said hot water storage means comprising overflow means between said recycle water tank and said hot water tank, filter means in said overflow means, and access means at the top of said array of tanks to permit access to said filter means.

10. The combination of claim 1, and water treatment means associated with said hot water storage means for treating the water stored in said hot water storage means.

11. A water and heat energy conservation system for a laundry of the type which comprises a plurality of individual automatically operated washing machines and a single hot water supply for all of said machines, the combination comprising a modular substantially self-contained system comprising an array of a hot water storage tank, a recycle water tank, and a waste water storage tank, diverter valve means associated with the water effluent exit of each of said washing machines for selectively directing the water effluent from every bath during the cycle of the operation of each of said machines into either said recycle water tank or said waste water tank, said diverter valve means comprising a housing positioned over and overlying portions of both of said waste water tank and said recycle water tank, said diverter valve means further comprising an "L" shaped diverter valve member which in one position directs the effluent flow from the machine into one of said tanks and in the other position of said valve directs the effluent flow into the other of said waste water tank and said recycle water tank, means to supply water from said recycle water tank to said hot water storage tank, and means to supply hot water from said hot water storage tank to each of said washing machines.

12. The combination of claim 11, and water treatment means associated with said hot water storage tank.

13. The combination of claim 11, said diverter valve means comprising a power operated diverted valve member positioned in said water exit, and said diverter valve means comprising an "L" shaped valve member is adapted to direct the water effluent from each said machine into one of said waste water tank and said recycle water tank and in the other position of said diverter valve member is adapted to direct the water effluent from said machine into the other of said waste water tank and said recycle water tank.

14. The combination of claim 11, wherein said exit from said machine comprises a conduit, and a pump means in said conduit to pump the water from said machine to said diverter valve means associated with said tanks.

15. The combination of claim 11, a water boiler associated with said hot water storage tank, fresh makeup water supply means, means to supply water from one, the other, or combinations of both of said fresh water supply means and said recycle water handling means to said boiler, said boiler comprising manifold means to supply water to all of said washing machines individually, and means to selectively bypass the water-heating means in said boiler in flowing water from one, the other, or combinations of both of said fresh water supply and said recycle water supply through said boiler to said manifold means.

16. The combination of claim 15, means to supply fresh makeup water to said hot water storage tank, heat exchanger means positioned in said waste water tank, and means to direct said fresh makeup water through said heat exchanger means, whereby said fresh water is preheated by recycling the heat in the waste water before said fresh water is fed into said hot water storage tank, and automatic valve means controlling the flow of preheated feed water from said heat exchanger into said boiler.

17. The combination of claim 11, said array of said hot water storage tank, said recycle water tank, and said waste water tank, comprising an array of nested tanks, with the recycle water tank being between the outermost waste water tank and the innermost hot water tank, whereby the natural flow of heat between said tanks tends to be economical of the heat energy in the water in all of said tanks.

18. The combination of claim 17, said means to supply water from said recycle water tank to said hot water storage means comprising overflow means between said recycle water tank and said hot water tank, filter means in said overflow means, and access means at the top of said array of tanks to permit access to said filter means.

19. The combination of claim 11, means to supply fresh makeup water to said hot water storage tank, heat exchanger means positioned in said waste water tank and means to direct said fresh makeup water through said heat exchanger means, whereby said fresh water is preheated by recycling the heat in the waste water before said fresh water is fed into said hot water storage tank.

* * * * *